US006200351B1

(12) United States Patent
Schleinig et al.

(10) Patent No.: US 6,200,351 B1
(45) Date of Patent: Mar. 13, 2001

(54) INSTITUTIONAL WASHING PROCESS USING SOIL-RELEASE POLYMER

(75) Inventors: Chris Schleinig, Duesseldorf; Edgar Koeppelmann; Thomas Merz, both of Hilden, all of (DE)

(73) Assignee: Henkel-Ecolab GmbH & Co. OHG, Duesseldorf (DE)

( * ) Notice: Subject to any disclaimer, the term of this patent is extended or adjusted under 35 U.S.C. 154(b) by 0 days.

(21) Appl. No.: 09/308,123

(22) PCT Filed: Nov. 4, 1997

(86) PCT No.: PCT/EP97/06083

§ 371 Date: May 13, 1999

§ 102(e) Date: May 13, 1999

(87) PCT Pub. No.: WO98/21303

PCT Pub. Date: May 22, 1998

(30) Foreign Application Priority Data

Nov. 13, 1996 (DE) ..... 196 46 866

(51) Int. Cl.[7] ..... D06M 15/507

(52) U.S. Cl. ..... 8/115.6; 8/115.7; 8/116.1; 8/137

(58) Field of Search ..... 8/137, 115.6, 115.7, 8/116.1; 510/473, 475

(56) References Cited

U.S. PATENT DOCUMENTS

| | | | | |
|---|---|---|---|---|
| 4,000,093 | | 12/1976 | Nicol et al. | 252/529 |
| 4,100,094 | | 7/1978 | Burns et al. | 252/89 |
| 4,116,885 | | 9/1978 | Derstadt et al. | 252/532 |
| 4,240,918 | | 12/1980 | Lagasse et al. | 252/95 |
| 4,441,881 | * | 4/1984 | Ruppert et al. | 8/137 |
| 4,749,596 | * | 6/1988 | Evans et al. | 427/242 |
| 4,908,039 | * | 3/1990 | Holland et al. | 8/137 |
| 5,538,671 | | 7/1996 | Morrall | 510/476 |

FOREIGN PATENT DOCUMENTS

| | | | |
|---|---|---|---|
| 814 956 | | 6/1969 | (CA) . |
| 958 618 | | 12/1974 | (CA) . |
| 989 557 | | 5/1976 | (CA) . |
| 1 232 108 | | 2/1988 | (CA) . |
| 16 17 141 | | 4/1972 | (DE) . |
| 22 53 063 | | 3/1973 | (DE) . |
| 22 00 911 | | 10/1973 | (DE) . |
| 26 13 791 | | 10/1976 | (DE) . |
| 28 46 984 | | 5/1979 | (DE) . |
| 28 57 292 | | 2/1980 | (DE) . |
| 33 24 258 | | 1/1984 | (DE) . |
| 44 17 686 | | 11/1995 | (DE) . |
| 195 02 181 | | 8/1996 | (DE) . |
| 0 066 944 | | 12/1982 | (EP) . |
| 0 185 427 | | 6/1986 | (EP) . |
| 0 241 984 | | 10/1987 | (EP) . |
| 0 241 985 | | 10/1987 | (EP) . |
| 0 253 567 | | 1/1988 | (EP) . |
| 0 272 033 | | 6/1988 | (EP) . |
| 0 274 907 | | 7/1988 | (EP) . |
| 0 357 280 | | 3/1990 | (EP) . |
| 0 736 595 | | 10/1996 | (EP) . |
| 0 736 596 | | 10/1996 | (EP) . |
| 95 531 | | 9/1988 | (RO) . |
| WO 95/17048 | * | 6/1996 | (WO) . |
| WO96/24657 | | 8/1996 | (WO) . |

OTHER PUBLICATIONS

Chemical Patents Index, Documentation Abstracts Journal, AN128015, XP002069689.
Tenside Surfactants Detergents, vol. 24, (1987) pp. 341–349.
Derwent Patent Abstract (WPAT) No. 89–128015/17.
Derwent Patent Abstract (WPAT) No. 68–81679P/00.
Derwent Patent Abstract (WPAT) No. 72–50636T/32.
Derwent Patent Abstract (WPAT) No. 73–27499U/20.
Derwent Patent Abstract (WPAT) No. 84–019090/04.
Derwent Patent Abstract (WPAT) No. 78–72508A/40.
Derwent Patent Abstract (WPAT) No. 79–33374B/18.
Derwent Patent Abstract (WPAT) No. 76–77573X/42.
Derwent Patent Abstract (WPAT) No. 96–384431/38.
Derwent Patent Abstract (WPAT) No. 96–000383/01.
Derwent Patent Abstract (WPAT) No. 96–020542/02.

* cited by examiner

*Primary Examiner*—John Hardee
(74) *Attorney, Agent, or Firm*—Wayne C. Jaeschke; Glenn E. J. Murphy

(57) ABSTRACT

An institutional textile washing process comprising a washing step preceded by a pretreatment step comprising a soaking step or a prewash step, wherein the textile is treated in the pretreatment step in the presence of water with a soil release polymer comprising a copolyester of a dicarboxylic acid and a diol or a polydiol.

14 Claims, No Drawings

INSTITUTIONAL WASHING PROCESS USING SOIL-RELEASE POLYMER

BACKGROUND OF THE INVENTION

This invention relates to an institutional washing process in which a soil release polymer is used in a separate pretreatment step.

Besides the ingredients essential to the washing process, such as surfactants and builders, detergents generally contain other constituents which may be collectively referred to as washing auxiliaries and which comprise such diverse groups of active substances as foam regulators, redeposition inhibitors, bleaching agents, bleach activators and dye transfer inhibitors. Auxiliaries of the type in question also include substances which provide the fibers with soil-repellent properties and which, if present during the washing process, support the soil release capacity of the other detergent ingredients. The same also applies to cleaning compositions for hard surfaces. Substances such as these are often referred to as soil release agents or, by virtue of their ability to provide the treated surface, for example the fibers, with soil-repellent properties, as soil repellents. By virtue of their chemical similarity to polyester fibers, copolyesters containing dicarboxylic acid units, alkylene glycol units and polyalkylene glycol units are particularly effective soil release agents. However, copolyesters are also capable of developing the required effect in non-polyester fabrics. Soil release copolyesters of the type mentioned and their use in detergents have been known for some time.

Thus, DE-OS 16 17 141 describes a washing process using polyethylene terephthalate/polyoxyethylene glycol copolymers. DE-OS 22 00 911 relates to detergents containing a nonionic surfactant and a copolymer of polyoxyethylene glycol and polyethylene terephthalate. DE-OS 22 53 063 mentions acidic textile finishes containing a copolymer of a dibasic carboxylic acid and an alkylene or cycloalkylene polyglycol and, optionally, an alkylene or cycloalkylene glycol. According to DE-OS 33 24 258, ethylene terephthalate/polyethylene oxide terephthalate polymers with molecular weights of 15,000 to 50,000, in which the polyethylene glycol units have molecular weights of 1,000 to 10,000 and the molar ratio of ethylene terephthalate to polyethylene oxide terephthalate is 2:1 to 6:1, may be used in detergents. European patent EP 066 944 relates to fabric treatment compositions containing a copolyester of ethylene glycol, polyethylene glycol, aromatic dicarboxylic acid and sulfonated aromatic dicarboxylic acid in certain molar ratios. European patent EP 185 427 mentions methyl-terminated or ethyl-terminated polyesters containing ethylene and/or propylene terephthalate and polyethylene oxide terephthalate units and detergents containing this soil release polymer. European patent EP 241 984 relates to polyesters which contain substituted ethylene units and glycerol units in addition to oxyethylene groups and terephthalic acid units. European patent EP 241 985 discloses polyesters which, in addition to oxyethylene groups and terephthalic acid units, contain 1,2-propylene, 1,2-butylene and/or 3-methoxy-1,2-propylene groups and glycerol units and which are terminated by $C_{1-4}$ alkyl groups. European patent EP 253 567 relates to soil release polymers with a molecular weight of 900 to 9,000 of ethylene terephthalate and polyethylene oxide terephthalate, the polyethylene glycol units having molecular weights of 300 to 3,000 and the molar ratio of ethylene terephthalate to polyethylene oxide terephthalate being 0.6 to 0.95:1. Polyesters containing polypropylene terephthalate and polyoxyethylene terephthalate units which are at least partly terminated by $C_{1-4}$ alkyl or acyl groups are known from European patent application EP 272 033. European patent EP 274 907 describes sulfoethyl-terminated terephthalate-containing soil release polyesters. According to European patent application EP 357 280, soil release polymers containing terephthalate, alkylene glycol and poly-$C_{2-4}$-glycol units are prepared by sulfonation of unsaturated terminal groups. Polymers of ethylene terephthalate and polyethylene oxide terephthalate, in which the polyethylene glycol units have molecular weights of 750 to 5,000 and the molar ratio of ethylene terephthalate to polyethylene oxide terephthalate is 50:50 to 90:10 and their use in detergents is described in German patent DE 28 57 292. German patent DE 28 46 984 discloses certain hydrophilic polyurethanes and copolyesters containing recurring alkoyl terephthalate and polyalkoyl terephthalate units and mixtures thereof as anti-soil detergent ingredients. Detergents containing 0.1 to 3% by weight of soil-releasing alkyl cellulose ethers, hydroxyalkyl cellulose ethers or hydroxyalkyl alkyl cellulose ethers are described in German patent DE 26 13 791.

However, all the documents mentioned above relate to detergents for domestic washing. The conditions typical of domestic washing, more particularly the action times of the wash liquor on the laundry to be cleaned of at least 30 minutes and the relatively low alkalinity of the washing liquor of, generally, well below pH 10, differ considerably from those typically prevailing in institutional laundries. Here, the total time taken by the laundry to pass through the continuous batch washing machine with the treatment steps of wetting, prewashing, main washing, rinsing and optionally neutralization is only about 20 to 40 minutes, a period of only a few minutes being allocated for the actual washing process in the main wash zone. Another factor to be taken into account is that, in institutional laundries, the washing is normally much more heavily soiled than in the domestic sector. In order to obtain a satisfactory washing result under these conditions, washing in institutional laundries is normally carried out at far higher pH values than washing in the home. Another difference in relation to domestic detergents is that detergents for institutional washing often contain neither bleaching agent nor bleach activator because, in institutional washing, bleaching and disinfection can be carried out in a separate step, normally in one of the last zones before leaving the continuous batch washing machine.

International patent application WO 96/24657 relates to a highly alkaline detergent for use in institutional laundries which contains the above-mentioned soil release polymer and which leads to a significant improvement in cleaning performance when used in the main wash cycle of institutional washing processes.

It has surprisingly been found that cleaning performance in institutional laundries can be distinctly improved if the soil release polymer, in addition to or instead of being used in the actual detergent, is used in a separate pretreatment step.

Accordingly, the present invention relates to the use of soil release polymer in the soaking or prewash step of institutional washing processes.

The general principles of conventional institutional washing processes are described briefly in the following. A detailed account can be found, for example, in the article by H. Kräßmann and H. G. Hloch entitled "Waschverfahren in der Gewerblichen Wäscherei (Institutional Washing Processes)", Tenside Surfactants Detergents 24 (1987), 341–349 and the literature cited therein.

Institutional washing processes differ from domestic washing processes inter alia in the fact that, although various types of fabrics and differently soiled fabrics have to be washed, the bulk of the laundry within the material sent for washing is normally the same so that a washing technique specially adapted to the particular cleaning function can be applied. However, there is a greater need for high-performance cleaning processes in institutional washing than in domestic washing because heavily soiled laundry, for example oil- and pigment-soiled working apparel, can accumulate.

In order to keep the consumption of detergent as low as possible, the water used for institutional washing is almost always free from hardness ions.

Whereas domestic washing is carried out almost exclusively in liquor-changing drum-type washing machines, various standard processes exist in institutional laundries. Thus, normal domestic washing with liquor-hanging washer-extractors can also be applied to the institutional sector. In these washer-extractors, the washing is successively exposed to various washing and rinsing conditions in a drum, the used liquor leaving the drum on completion of the particular wash phase. The individual steps are made up of soaking, prewashing, main washing, rinsing and spinning or pressing.

So-called continuous batch washing machines, which consist of several successive washing compartments or of a single washing compartment divided by partitions into several sections or chambers, are generally superior to this discontinuous process by virtue of the normally higher throughput of laundry. In continuous batch washing machines, the individual washing steps take place in various zones of the machine through which the laundry passes under program control. Continuous batch washing machines can operate either on the bath-changing principle or with stationary baths. Continuous batch washing machines generally operate on the countercurrent principle, fresh water and dirty washing being introduced into the washing process at opposite ends of the washing machine and moving through the washing machine in more or less opposite directions. Fresh water freed from hardness ions enters the rinsing zone through which the laundry passes as the last zone in about 1 to 10 minutes and from which part is delivered to the main wash zone. Another part of the water emanating from the rinsing zone is often used, together with the water accumulating in the pressing zone of the continuous batch washing machine, for the first step of the washing process, namely wetting of the dry soiled laundry and introduction into the first bath of the continuous batch washing machine. After automatic addition of one or more detergents, the soiled laundry is normally prewashed at 35 to 45° C. and, after a predetermined time, is automatically further transported. The prewash step may also be carried out in several successive units. The used water normally leaves the continuous batch washing machine at the end of the prewash zone. After leaving the prewash zone, the laundry enters the main wash zone which generally consists of several units, often more than ten in number. Because the countercurrent of the water flow is superimposed on the intermittent co-current emanating from transport of the laundry, which results in complicated concentration conditions, the main wash detergent is generally not added in the first unit, but in one of the middle units. Bleaching agents, for example hydrogen peroxide or peracetic acid, are normally added in this zone. Also in this zone, the laundry is automatically further transported into the next unit, normally after freely programmable cycle times. In the course of the final rinsing step, the laundry is normally neutralized ("acidified") by automatically dosed addition of organic acids to the aqueous rinsing solution. Neutralization is essential on account of the use of soft water in conjunction with the alkaline cleaning baths of the main washing step.

DESCRIPTION OF THE INVENTION

The modification according to the invention of these known processes for the institutional washing of laundry essentially comprises treating the textiles to be washed with the soil release polymer in the presence of water before the main washing step, i.e. in the soaking or prewash phase. Treatment times of 5 minutes to 60 minutes and, more particularly, 10 minutes to 40 minutes at temperatures of 30° C. to 90° C. and, more particularly, 30° C. to 60° C. are normally quite sufficient. The soil release polymer is used in quantities of normally 0.1 g to 100 g, preferably 1 g to 20 g and more preferably 1 g to 10 g per kg of dry laundry. The liquor ratio, i.e. the ratio of the weight of dry laundry to be washed to the quantity of water containing soil release polymer, is preferably in the range from 1:3 to 1:30 and more preferably in the range from 1:5 to 1:10.

Suitable soil release polymers for the purposes of the invention are, in particular, copolyesters of dicarboxylic acids, for example adipic acid, phthalic acid or terephthalic acid, diols, for example ethylene glycol or propylene glycol, and polydiols, for example polyethylene glycol or polypropylene glycol, and nonionic hydroxyalkyl cellulose ethers, for example hydroxypropyl cellulose.

Suitable soil release polyesters are known from the documents cited above and from German patent applications DE 44 17 686 and DE 195 02 181 and are commercially obtainable, for example, under the names of Sokalan® (BASF) and Velvetol® 251C (Rhône Poulenc). Preferred soil release polyesters include compounds which, formally, can be obtained by esterifying two monomers, the first monomer being a dicarboxylic acid HOOC—Ph—COOH and the second monomer being a diol H—(O—(CHR$^3$—)$_a$OH, which may also be present as polymeric diol H—(O—(CHR$^3$—)$_a$)$_b$OH. In these formulae, Ph represents an o-, m- or p-phenylene group which may carry 1 to 4 substituents selected from $C_{1-22}$ alkyl groups, sulfonic acid groups, carboxyl groups and mixtures thereof, $R^3$ is hydrogen, a $C_{1-22}$ alkyl group or mixtures thereof, a is a number of 2 to 6 and b is a number of 1 to 300. The polyesters obtainable from these monomers preferably contain both monomer diol units O—(CHR$^3$—)$_a$O— and polymer diol units —(O—(CHR$^3$—)$_a$)$_b$O—. The molar ratio of monomer diol units to polymer diol units is preferably 100:1 to 1:100 and, more preferably, 10:1 to 1:10. In the polymer diol units, the degree of polymerization b is preferably in the range from 4 to 200 and more preferably in the range from 12 to 140. The molar weight or rather the average molecular weight or the maximum of the molecular weight distribution of preferred soil release polyesters is in the range from 250 to 100,000 and more preferably in the range from 500 to 50,000. The acid on which the group Ph is based is preferably selected from terephthalic acid, isophthalic acid, phthalic acid, trimellitic acid, mellitic acid, the isomers of sulfophthalic acid, sulfoisophthalic acid and sulfoterephthalic acid and mixtures thereof. If their acid groups are not part of the ester bonds in the polymer, they are preferably present in salt form, more particularly as alkali metal or ammonium salts. Of these, the sodium and potassium salts are particularly preferred. If desired, all of the monomer HOOC—Ph—COOH or, more particularly, no more than 10 mole-%, based on the percentage content of Ph with the meaning defined above, may be replaced by other acids containing at least two carboxyl groups in the soil release polyester. These acids include, for example, alkylene and alkenylene dicarboxylic acids, such as malonic acid, succinic acid, fumaric acid, maleic acid, glutaric acid, adipic acid, pimelic acid, suberic acid, azelaic acid and sebacic acid. The preferred diols HO—($CHR^3$—)$_a$OH include those in which $R^3$ is hydrogen and a is a number of 2 to 6 and those in which a has a value of 2 and $R^3$ is selected from hydrogen and alkyl groups containing 1 to 10 and, more particularly, 1 to 3 carbon atoms. Among the last-mentioned diols, those with the formula HO—$CH_2CHR^3$—OH, where $R^3$ is as defined above, are particularly preferred. Examples of diol components are ethylene glycol, 1,2-propylene glycol, 1,3-propylene glycol, butane-1,4-diol, pentane-1,5-diol, hexane-1,6-diol, octane-1,8-diol, decane-1,2-diol, dodecane-1,2-diol and neopentyl glycol. Among the polymeric diols, polyethylene glycol with an average molecular weight of 1,000 to 6,000 is particularly preferred.

If desired, the polyesters having the composition described above may also be end-capped, suitable terminal groups being alkyl groups containing 1 to 22 carbon atoms and esters of monocarboxylic acids. The terminal groups attached via ester bonds may be based on alkyl, alkenyl and aryl monocarboxylic acids containing 5 to 32 carbon atoms and, more particularly, 5 to 18 carbon atoms. These include valeric acid, caproic acid, oenanthic acid, caprylic acid, pelargonic acid, capric acid, undecanoic acid, undecenoic acid, lauric acid, lauroleic acid, tridecanoic acid, myristic acid, myristoleic acid, pentadecanoic acid, palmitic acid, stearic acid, petroselic acid, petroselaidic acid, oleic acid, linoleic acid, linolaidic acid, linolenic acid, elaeostearic acid, arachic acid, gadoleic acid, arachidonic acid, behenic acid, erucic acid, brassidic acid, clupanodonic acid, lignoceric acid, cerotic acid, melissic acid, benzoic acid which may contain 1 to 5 substituents with a total of up to 25 carbon atoms, more particularly 1 to 12 carbon atoms, for example tert.butyl benzoic acid. The terminal groups may also be based on hydroxymonocarboxylic acids containing 5 to 22 carbon atoms which include, for example, hydroxyvaleric acid, hydroxycaproic acid, ricinoleic acid, the hydrogenation product thereof, hydroxystearic acid and o-, m- and p-hydroxybenzoic acid. The hydroxymonocarboxylic acids may in turn be attached to one another by their hydroxyl group and their carboxyl group and, accordingly, may occur repeatedly in one and the same terminal group. The number of hydroxymonocarboxylic acid units per terminal group, i.e. their degree of oligomerization, is preferably in the range from 1 to 50 and, more preferably, in the range from 1 to 10.

A preferred embodiment of the invention is characterized by the use of polymers of ethylene terephthalate and polyethylene oxide terephthalate in which the polyethylene glycol units have molecular weights of 750 to 5,000 and the molar ratio of ethylene terephthalate to polyethylene oxide terephthalate is 50:50 to 90:10.

Nonionic hydroxyalkyl cellulose ethers suitable for use as soil release polymers in accordance with the invention include in particular hydroxyethyl, hydroxypropyl and/or hydroxybutyl celluloses which may additionally carry alkyl ether groups, more particularly, methyl, ethyl and/or propyl groups. Their content of hydroxyalkoxy groups is preferably from 1% by weight to 20% by weight, more preferably from 2% by weight to 15% by weight and most preferably from 5% by weight to 10% by weight, based on nonionic hydroxyalkyl cellulose ether. If additional alkoxy groups are present, their content is preferably from 15% by weight to 30% by weight and, more preferably, from 20% by weight to 30% by weight, based on nonionic hydroxyalkyl cellulose ether. Anionic cellulose ethers, for example carboxymethyl cellulose, are significantly less effective than nonionic cellulose ethers. Preferred nonionic cellulose ethers include alkyl hydroxyalkyl celluloses, for example methyl hydroxyethyl cellulose, methyl hydroxypropyl cellulose, methyl hydroxybutyl cellulose, ethyl hydroxyethyl cellulose, ethyl hydroxypropyl cellulose and/or ethyl hydroxybutyl cellulose.

Another preferred embodiment of the invention is characterized by the use of combinations of the esters mentioned above with the nonionic cellulose ethers mentioned above in quantity ratios of, preferably, 1:1 to 1:10 and, more preferably, 1:1 to 1:5. If nonionic cellulose ether is used as the soil release polymer, it may be present in the form of, for example, a solid mixture of the cellulose ether with up to about 10% by weight of sodium chloride and about 6% by weight to 8% by weight of water without any adverse effect on the improvement in oil and fat removal.

Both in the use according to the invention and in the process according to the invention, the soil release polymer may be used either on its own or as part of a presoak or prewash composition which may contain all the other ingredients typical of such compositions, including for example nonionic surfactants, enzymes, phosphates and silicates and also polymeric polycarboxylates.

After the treatment according to the invention with the soil release polymer, the laundry is subjected to the washing process, preferably without preliminary rinsing, using the standard methods mentioned above or methods based thereon.

EXAMPLES

In a Frista® machine, the fabrics listed in the following Table were pretreated (30 minutes, 30° C., no rinsing out) with a 1:1 mixture of methyl hydroxypropyl cellulose and a polymer of ethylene terephthalate and polyethylene oxide terephthalate (Velvetol®, a product of Rhône Poulenc) in a quantity of 3 g per kg of dry laundry, subsequently provided with the soils listed in Table 1, washed with a standard detergent (Silex perfect®) in an E-Lux® washing machine (5 minutes 30° C., 50 minutes 60° C.; water hardness 0° dH) and dried. The cycle then began again, the soils being applied to the same places in order to simulate repeated use. All the fabrics were washed 6 times (process I).

In a modification of this procedure, the pretreatment was only carried out after every third wash and not after every wash (process II).

For comparison, the pretreatment with the soil release polymer was omitted altogether (process III).

The test fabrics were then dried and evaluated by a panel of 5 examiners for cleanness or rather freedom from stains on a scale of 0 to 3 where 0=complete stain removal 1=slight residues 2=distinctly visible residues 3=almost as starting value The average values of the individual evaluations are set out in Table 1. It can be seen that significantly better cleaning results are obtained in the process according to the invention (process I and process II) than in conventional washing processes (process III). Comparable results were obtained when the mixture of methyl hydroxypropyl cellulose and a polymer of ethylene terephthalate and a polyethylene oxide terephthalate was replaced by the polymer as sole soil release agent.

TABLE 1

Evaluation of washing performance

| Soil/fabric | Process I | Process II | Process III |
|---|---|---|---|
| A | 2 | 3 | 3 |
| B | 2 | 2 | 2 |
| C | 2 | 2 | 2 |
| D | 0 | 1 | 2 |
| E | 1 | 1 | 1 |
| F | 1 | 2 | 2 |
| Average | 1.3 | 1.8 | 2.0 |

Soil/fabric:
A used engine oil on polyester
B used engine oil on cotton
C used engine oil on cotton/polyester blend
D mixture of dust/sebum paste with engine oil on polyester
E mixture of dust/sebum paste with engine oil on cotton
F mixture of dust/sebum paste with engine oil on cotton/polyester blend

What is claimed is:

1. An institutional textile washing process comprising a washing step preceded by a pretreatment step comprising a soaking step or a prewash step, wherein the textile is treated in the pretreatment step in the presence of water with a soil release polymer comprising a copolyester of a dicarboxylic acid and a diol or a polydiol.

2. A process according to claim 1, wherein the polyester is a copolymer of ethylene terephthalate and polyethyleneoxide terephthalate, wherein the polyethylene glycol units have a molecular weight of 750 to 5000 and the molar ratio of ethylene terephthalate to polyethyleneoxide terephthalate is 50:50 to 90:10.

3. A process according to claim 1, wherein the soil release polymer is combination of the polyester and a nonionic hydroxyalkyl cellulose ether in a weight ratio of 1:1 to 1:10.

4. A process according to claim 3, wherein the soil release polymer is combination of the polyester and the nonionic hydroxyalkyl cellulose ether in a weight ratio of 1:1 to 1:5.

5. A process according to claim 1, wherein the treatment time with the soil release polymer is 5 to 60 minutes.

6. A process according to claim 5, wherein the treatment time with the soil release polymer is 10 to 40 minutes.

7. A process according to claim 1, wherein the treatment with the soil release polymer is carried out a a temperature of 30° C. to 90° C.

8. A process according to claim 7, wherein the treatment with the soil release polymer is carried out a a temperature of 30° C. to 60° C.

9. A process according to claim 1, wherein the textile is treated with 0.1 to 100 grams of soil release polymer per kilogram of dry textile.

10. A process according to claim 9, wherein the textile is treated with 1 to 10 grams of soil release polymer per kilogram of dry textile.

11. A process according to claim 1, wherein the pretreatment step in which the textile is treated with the soil release polymer has a liquor ratio of 1:3 to 1:30.

12. A process according to claim 1, wherein the pretreatment step in which the textile is treated with the soil release polymer has a liquor ratio of 1:5 to 1:10.

13. An institutional textile washing process comprising a washing step preceded by a pretreatment step comprising a soaking step or a prewash step, wherein the textile in treated in the pretreatment step in the presence of water with a soil release polymer comprising a copolyester of ethylene terephthalate and polyethyleneoxide terephthalate, wherein the polyethylene glycol units have a molecular weight of 750 to 5000 and the molar ratio of ethylene terephthalate to polyethyleneoxide terephthalate is 50:50 to 90:10, wherein the treatment with the soil release polymer is carried out for 5 to 60 minutes at a temperature of 30° C. to 90° C. using 0.1 to 100 grams of soil release polymer per kilogram or dry textile at a liquor ratio of 1:3 to 1:30.

14. A process according to claim 13, wherein the treatment with the soil release polymer is carried out for 10 to 40 minutes at a temperature of 30° C. to 60° C. using 1 to 10 grams of soil release polymer per kilogram of dry textile at a liquor ratio of 1:5 to 1:10.

* * * * *